US010619518B2

(12) United States Patent
Eifert

(10) Patent No.: US 10,619,518 B2
(45) Date of Patent: Apr. 14, 2020

(54) EXHAUST SYSTEM WITH DIRECTED ENERGY BEAM INTERFERENCE AVOIDANCE SYSTEM

(71) Applicant: Rolls-Royce North American Technologies, Inc., Indianapolis, IN (US)

(72) Inventor: Andrew J. Eifert, Indianapolis, IN (US)

(73) Assignee: Rolls-Royce North American Technologies Inc., Indianapolis, IN (US)

( * ) Notice: Subject to any disclaimer, the term of this patent is extended or adjusted under 35 U.S.C. 154(b) by 913 days.

(21) Appl. No.: 15/236,910

(22) Filed: Aug. 15, 2016

(65) Prior Publication Data

US 2018/0045076 A1 Feb. 15, 2018

(51) Int. Cl.

| | |
|---|---|
| ***F01D 25/30*** | (2006.01) |
| ***F01D 15/04*** | (2006.01) |
| ***F23L 17/00*** | (2006.01) |
| ***F23J 11/04*** | (2006.01) |
| ***F41H 13/00*** | (2006.01) |
| ***B63H 21/34*** | (2006.01) |
| ***F23N 3/08*** | (2006.01) |

(52) U.S. Cl.

CPC ..... *F01D 25/30* (2013.01); *B63H 21/34* (2013.01); *F01D 15/045* (2013.01); *F23J 11/04* (2013.01); *F23L 17/00* (2013.01); *F23N 3/082* (2013.01); *F41H 13/005* (2013.01)

(58) Field of Classification Search

CPC .... F41H 13/0043; F41H 13/005; F01D 25/30; H01S 3/0071; H01S 3/09–0979; H01S 5/04–0428

See application file for complete search history.

(56) References Cited

U.S. PATENT DOCUMENTS

| | | | | |
|---|---|---|---|---|
| 3,634,778 | A * | 1/1972 | Melikian | H01S 3/0979 372/34 |
| 3,648,194 | A * | 3/1972 | Melikian | H01S 3/097 372/34 |
| 3,982,209 | A * | 9/1976 | Sutton | H01S 3/095 372/55 |
| 4,013,976 | A * | 3/1977 | Hill | H01S 3/0953 372/90 |
| 4,329,842 | A | 5/1982 | Hoskinson | |
| 5,682,400 | A * | 10/1997 | Krasnov | H01S 3/0975 372/60 |
| 5,706,650 | A * | 1/1998 | Thayer | F02K 1/008 239/265.17 |
| 5,957,495 | A * | 9/1999 | Korpi | B60K 13/04 280/762 |
| 6,338,253 | B1 | 1/2002 | Freedman | |
| 7,406,829 | B2 | 8/2008 | Coffinberry | |
| 9,477,135 | B1 * | 10/2016 | Uyeno | G02F 1/295 |

(Continued)

*Primary Examiner* — Gerald L Sung
*Assistant Examiner* — William L Breazeal
(74) *Attorney, Agent, or Firm* — Barnes & Thornburg LLP

(57) ABSTRACT

A self-powered laser system for discharging high energy light beams is disclosed. The laser system includes a laser unit, a power unit, and an exhaust system. The laser unit is capable of discharging beams in multiple directions. The exhaust system directs exhaust gasses discharged from the power unit.

20 Claims, 4 Drawing Sheets

(56) References Cited

U.S. PATENT DOCUMENTS

| | | | | |
|---|---|---|---|---|
| 2011/0115227 | A1* | 5/2011 | Shafer | F01D 15/10 290/52 |
| 2012/0160957 | A1* | 6/2012 | Gagne | B64D 27/00 244/54 |
| 2017/0145854 | A1* | 5/2017 | Skilton | F01D 21/045 |

* cited by examiner

EXHAUST SYSTEM WITH DIRECTED ENERGY BEAM INTERFERENCE AVOIDANCE SYSTEM

FIELD OF THE DISCLOSURE

The present disclosure relates generally to high energy beam systems, and more specifically to systems powered by fuel-burning generators.

BACKGROUND

Lasers and other energy beam devices discharge high energy light beams for various purposes. Such devices can be powered by electrical generators such that a self-powered system is provided. Some electrical generators include engines that discharge heated exhaust gas. Streams of heated exhaust gas can affect atmospheric conditions along an exhaust path near the system. The changed atmospheric conditions along an exhaust path can interfere with the direction and/or focus of high energy beams.

SUMMARY

The present disclosure may comprise one or more of the following features and combinations thereof.

According to one aspect of the present disclosure, a system may include a beam-producing unit (i.e. a laser unit), a power unit, and an exhaust system. The beam-producing unit may be configured to discharge high energy beams in multiple directions. The power unit may be coupled to the beam-producing unit and may be configured to provide pulses of electrical power to the beam-producing unit. The power unit may include a gas turbine engine and an exhaust conduit configured to conduct exhaust gasses produced during operation of the gas turbine engine. The exhaust system may be configured to direct the discharge of exhaust from the exhaust conduit.

In some embodiments, the exhaust system may include an exhaust director and a controller. The exhaust director may be reconfigurable from a first configuration in which the exhaust director causes exhaust gas to move in a first direction as it exits the exhaust conduit to a second configuration in which the exhaust director causes exhaust gas to move in second direction as it exits the exhaust conduit. The controller may be coupled to the exhaust director and may be adapted to reconfigure the exhaust director from the first configuration to the second configuration in response to receipt of information associated with high energy light beam guidance so that exhaust gas interference with the high energy light beams from the beam-producing unit is managed.

In some embodiments, the information associated with high energy beam guidance may include atmospheric information. In some embodiments, the information associated with high energy beam guidance may include beam-producing unit configuration information.

In some embodiments, the exhaust director includes a snorkel fluidly coupled to the exhaust conduit and a snorkel actuator coupled to the snorkel. The snorkel actuator may be configured to reposition the snorkel. An outlet end of the snorkel and an outlet end of the exhaust conduit may open in different directions.

In some embodiments, the exhaust director may include a Coanda nozzle. The Coanda nozzle may be fluidly coupled to a compressor included in the gas turbine engine. The exhaust director may include a valve fluidly coupled between the Coanda nozzle and the compressor. The controller may be configured open and close the valve in order to reconfigure the exhaust director.

In some embodiments, the exhaust director may include a fan configured to selectively direct air flow along a path to interact with exhaust gas as it exits the exhaust conduit. The fan may be configured to direct air flow from a heat exchanger included in the beam-producing unit.

According to yet another aspect of the present disclosure, a generator system adapted for use with a beam-producing unit (i.e. laser unit) may include a power unit and an exhaust system. The power unit may include a gas turbine engine and an exhaust conduit configured to conduct exhaust gasses produced during operation of the gas turbine engine. The exhaust system may be configured to direct the discharge of exhaust from the exhaust conduit.

In some embodiments, the exhaust system may include an exhaust director and a controller. The exhaust director may be reconfigurable from a first configuration in which the exhaust director causes exhaust gas to move in a first direction as it exits the exhaust conduit to a second configuration in which the exhaust director causes exhaust gas to move in second direction as it exits the exhaust conduit. The controller may be coupled to the exhaust director and may be adapted to reconfigure the exhaust director from the first configuration to the second configuration in response to receipt of information associated with high energy beam guidance so that exhaust gas interference with the high energy beams from the beam-producing unit is managed.

In some embodiments, the information associated with high energy beam guidance may include atmospheric information. In some embodiments, the information associated with high energy beam guidance may include beam-producing unit configuration information.

In some embodiments, the exhaust director may include a snorkel fluidly coupled to the exhaust conduit and a snorkel actuator coupled to the snorkel. The snorkel may be shaped to redirect exhaust gas exiting the exhaust conduit, and the snorkel actuator may be configured to reposition the snorkel.

In some embodiments, the exhaust director may include a Coanda nozzle. The Coanda nozzle may be configured to direct exhaust gas exiting the exhaust conduit upon receipt of pressurized gas supplied to the Coanda nozzle.

In some embodiments, the exhaust director may include a fan. The fan may be configured to selectively direct air flow along a path to interact with exhaust gas as it exits the exhaust conduit.

According to another aspect of the present disclosure, a system may include beam-producing unit (i.e. a laser unit), a power unit, and an exhaust system. The beam-producing unit may be movable to discharge high energy beams in multiple directions. The power unit may be coupled to the beam-producing unit and may be configured to provide pulses of electrical power to the beam-producing unit. The power unit may include a gas turbine engine and an exhaust conduit coupled to the gas turbine engine to conduct exhaust gasses produced during operation of the gas turbine engine. The exhaust system may be configured to direct the discharge of exhaust from the exhaust conduit.

In some embodiments, the exhaust system may include an exhaust director that directs exhaust gas as it exits the exhaust conduit and a mechanical linkage that extends from the beam-producing unit to the exhaust director. The mechanical linkage may couple the exhaust director to the beam-producing unit such that the exhaust director may be moved to change the direction of exhaust gas as it exits the exhaust conduit in response to movement of the beam-producing unit so that exhaust gas interference with the high energy light beams from the beam-producing unit is managed.

In some embodiments, the exhaust director may include a snorkel that is fluidly coupled to the exhaust conduit. The snorkel may be mounted for repositioning relative to the exhaust conduit.

These and other features of the present disclosure will become more apparent from the following description of the illustrative embodiments.

DETAILED DESCRIPTION OF THE DRAWINGS

Figure 1:
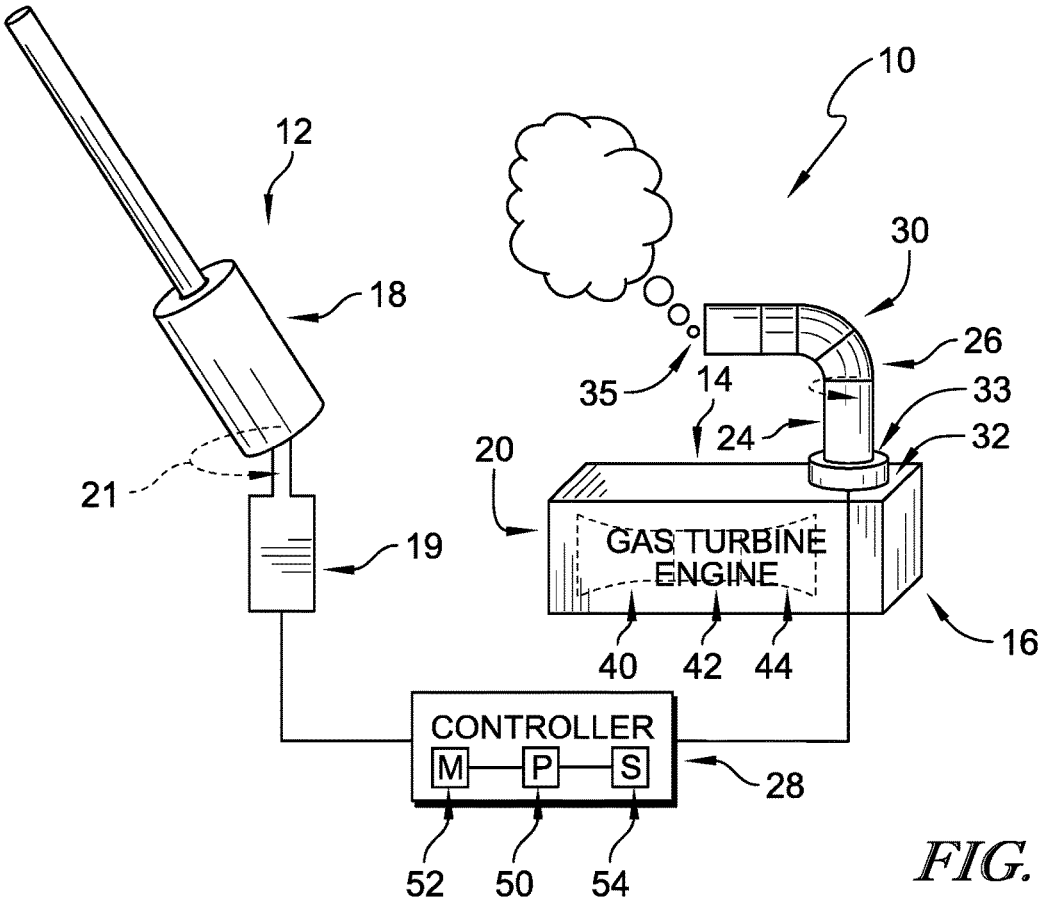
FIG. 1 is a partially diagrammatic view of a laser system that includes a laser unit, a power unit having a gas turbine engine, and an exhaust system with an exhaust director adapted to redirect exhaust discharged from the gas turbine engine so that the exhaust does not interfere with light beams from the laser unit.

For the purposes of promoting an understanding of the principles of the disclosure, reference will now be made to a number of illustrative embodiments illustrated in the drawings and specific language will be used to describe the same.

Self-powered systems 10, 210, 310, 410 illustratively include exhaust systems 16, 216, 316, 416 that actively control the path of exhaust gas discharged from an engine 20 that powers the systems 10, 210, 310, 410. By controlling the path of exhaust gas, the exhaust systems 16, 216, 316, 416 can mitigate interference from the exhaust gas that might affect a high energy beams produced by the systems 10, 210, 310, 410 shown. Accordingly, the systems 10, 210, 310, 410 may be able to more accurately guide high energy beams that other systems without controlled exhaust flow.

The illustrative self-powered systems 10, 210, 310, 410 each include a high energy laser unit 18 that produces light beams as suggested in FIGS. 1-4 and 6. Exhaust systems 16, 216, 316, 416 control the path of exhaust gas discharged from the engine 20 to reduce or eliminate interference between high energy light beams from the laser units 18. However, the exhaust systems 16, 216, 316, and 416 described in this disclosure may also be incorporated into systems with other beam-producing units, such as, for example, maser units, particle beam units, and/or the like that can suffer from atmospheric degradation near a beam path on account of exhaust gasses and exhaust materials (i.e. unused hydrocarbons and other particulates).

Exhaust systems 16, 216, 316 of FIGS. 1-4 are electromechanically controlled such that the redirection of exhaust flow out of the exhaust systems 16, 216, 316 is based on information associated with high energy beam guidance. Such guidance information may include atmospheric information (temperature, wind direction, humidity, etc.) or laser unit configuration (laser orientation, laser intensity, etc.). These systems 16, 216, 316 each include a exhaust director 26, 226, 326 and a controller 28, 228, 328 that reconfigures the corresponding exhaust director 26, 226, 326 based on guidance information.

Figure 2:
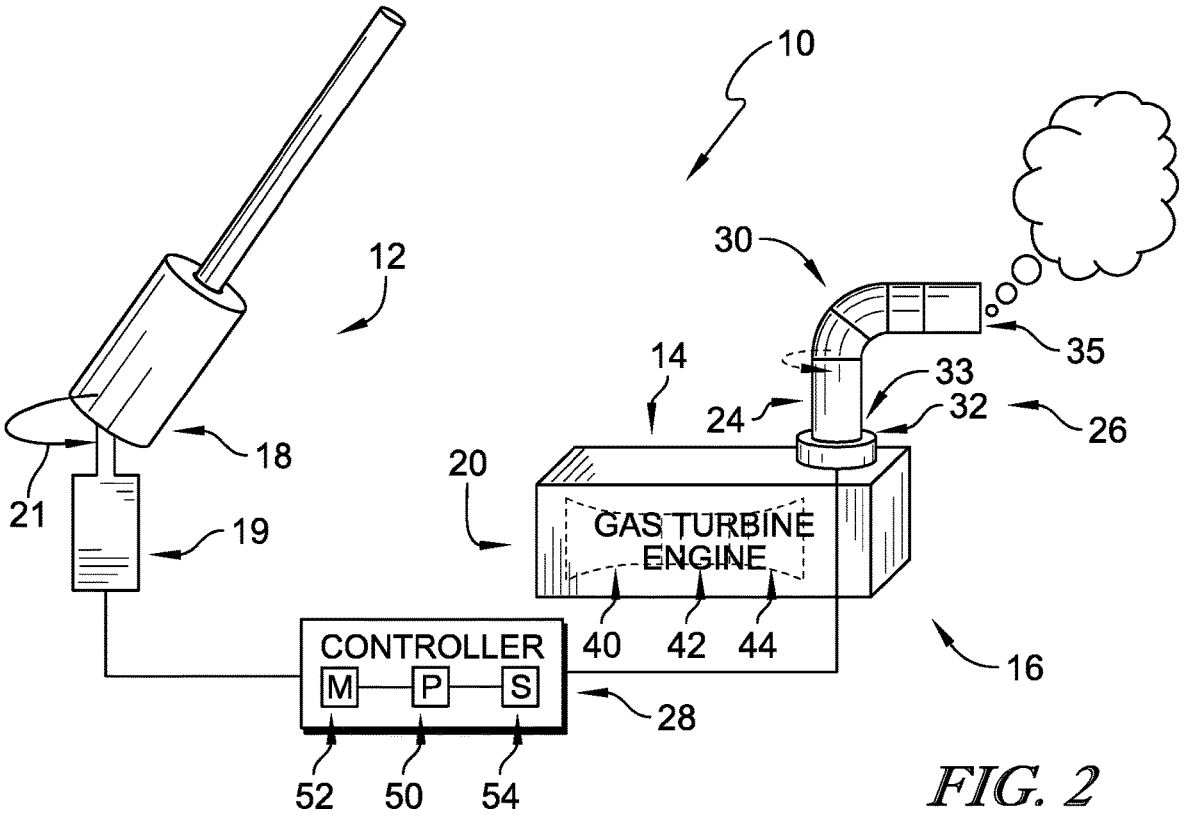
FIG. 2 is a partially diagrammatic view of the laser system of FIG. 1 showing that the exhaust director includes a snorkel fluidly connected to the exhaust conduit and a snorkel actuator adapted to rotate the snorkel to redirect exhaust from the gas turbine engine.
Figure 3:
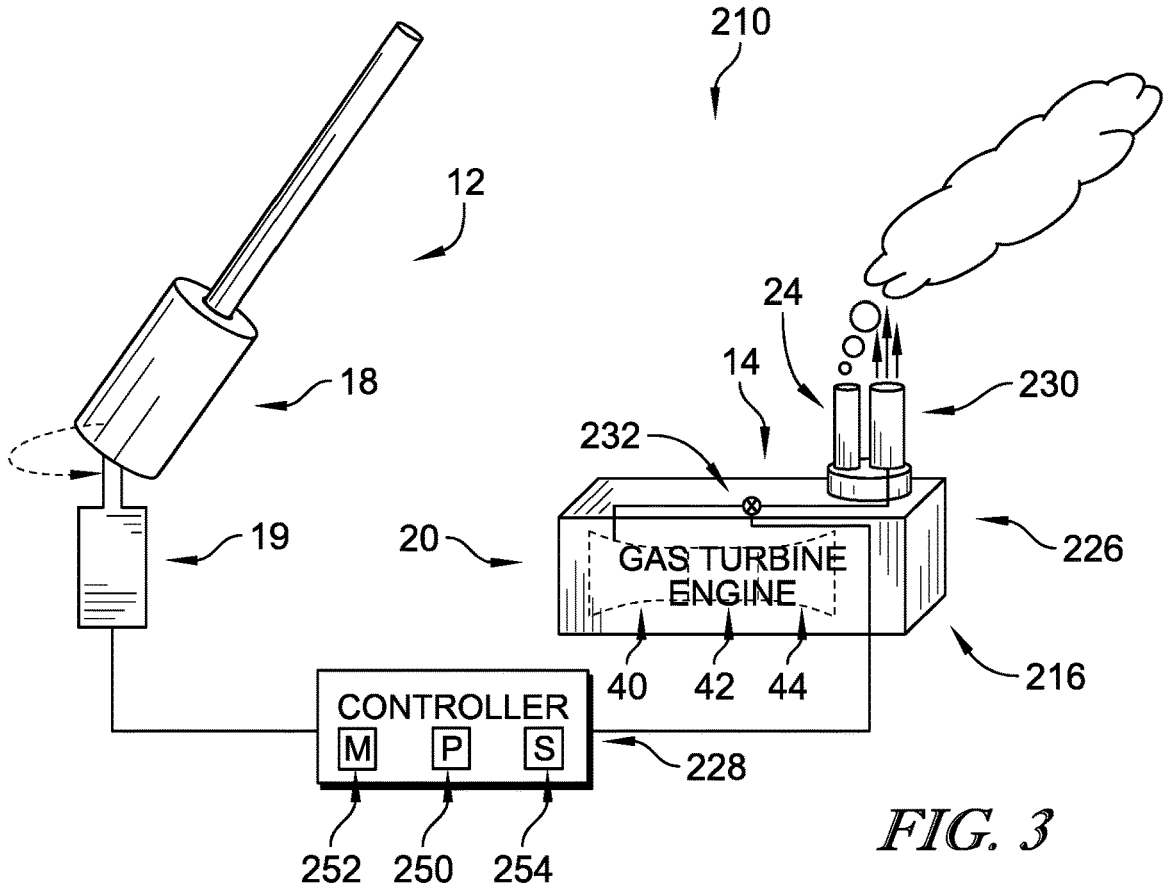
FIG. 3 is a partially diagrammatic view of a second laser system similar to the laser system in FIGS. 1 and 2 showing that an alternate exhaust director includes a Coanda nozzle fluidly connected to a compressor included in the gas turbine engine and a valve fluidly coupled between the Coanda nozzle and the compressor.
Figure 4:
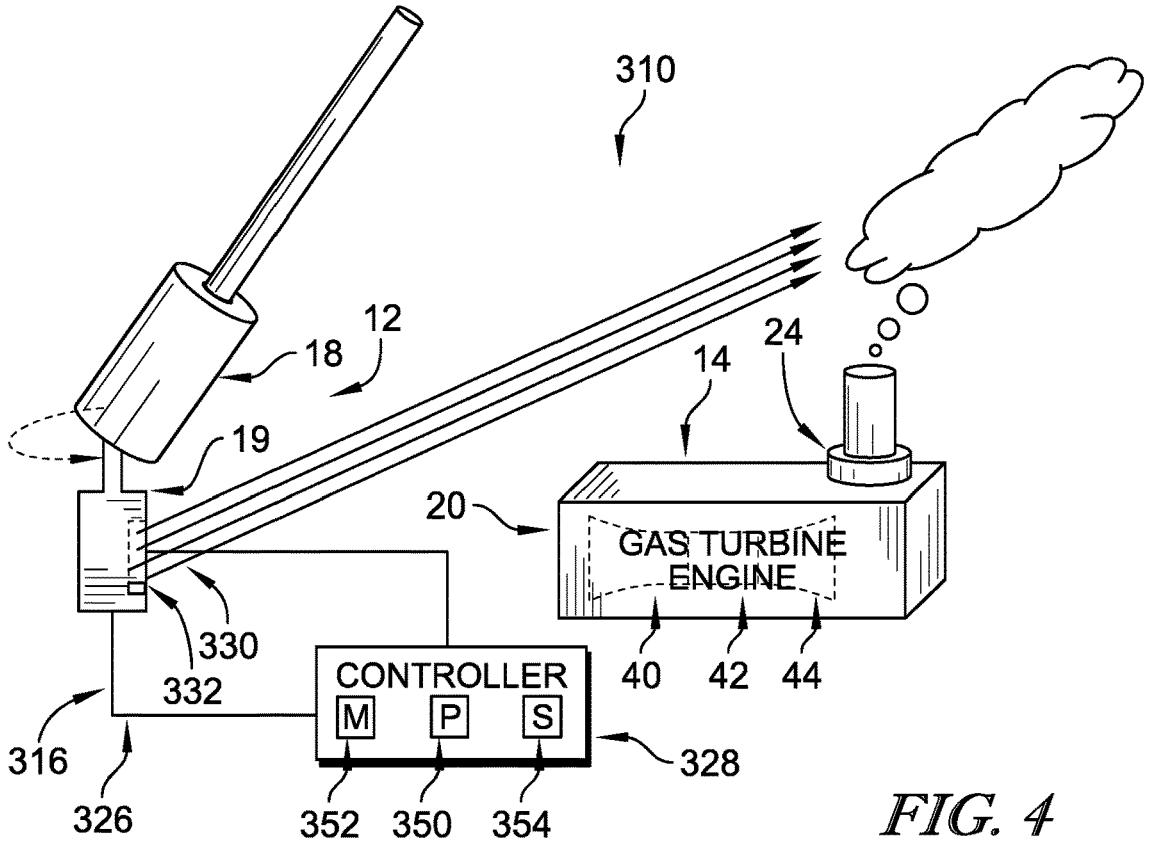
FIG. 4 is a partially diagrammatic view of a third laser system similar to the laser system in FIGS. 1 and 2 showing that an alternate exhaust director includes a fan configured to selectively direct air flow along a path to interact with exhaust gas from the gas turbine engine.

FIGS. 1 and 2 show a movable snorkel 30 that provides the exhaust director 26 of first laser system 10. FIG. 3 shows a Coanda nozzle 230 that provides the exhaust director 226 of second laser system 210. FIG. 4 shows a fan 330 that provides the exhaust director 326 of third laser system 310. Each of the devices 30, 230, 330 that provide an exhaust director 26, 226, 326 are reconfigurable by corresponding controllers 28, 228, 328 to change an exhaust gas path based on laser guidance information so that interference with laser beams can be avoided.

Figure 6:
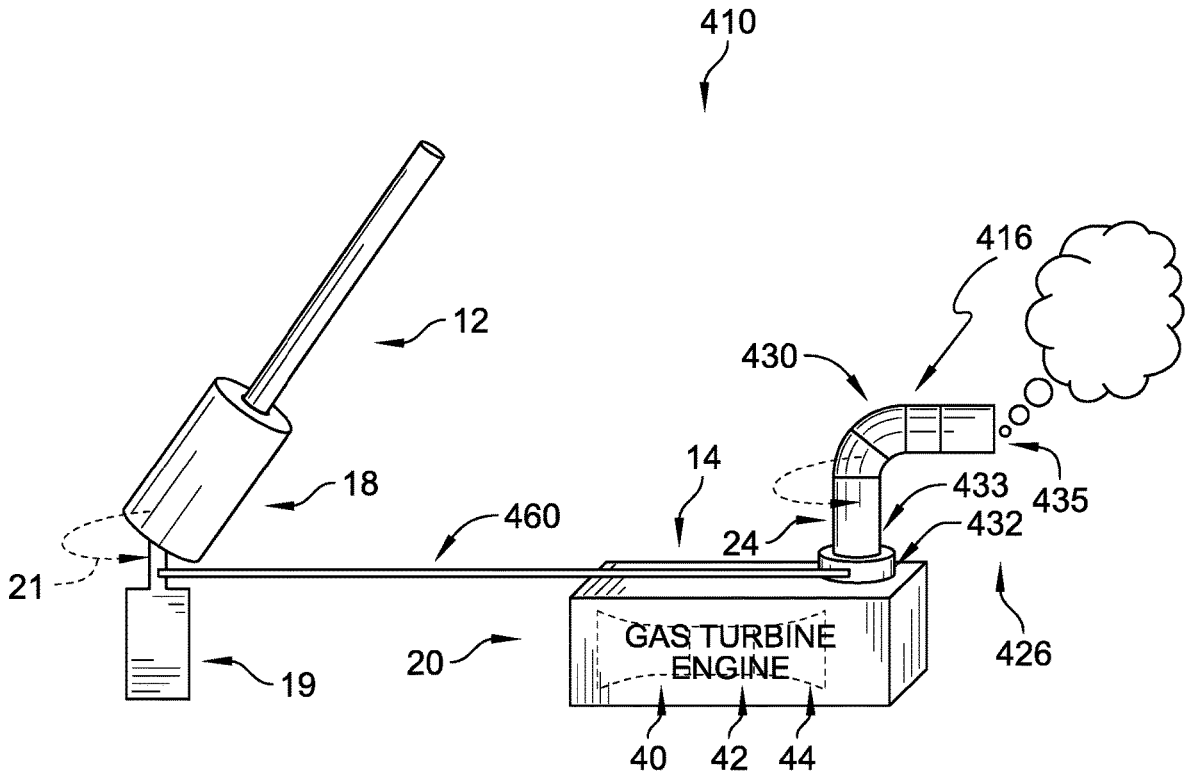
FIG. 6 is a partially diagrammatic view of a fourth laser system that includes a laser unit, a power unit having a gas turbine engine, an exhaust system having an exhaust director adapted to redirect exhaust discharged from the gas turbine engine, and further showing a mechanical linkage interconnecting the laser unit and the exhaust director so that the exhaust director is movable in response to movement of the laser unit.

Exhaust system 416 of FIG. 6 is mechanically controlled such that the redirection of exhaust flow out of the exhaust system 416 is based on the position of a movable laser 18 included in the laser system 416. A movable snorkel 430 illustratively provides the exhaust director 428 and is coupled to the movable laser 18 by a mechanical linkage 460. Accordingly, the exhaust director 430 is reconfigurable to change an exhaust gas path based on laser 18 position so that interference with laser beams can be avoided.

A first illustrative laser system 10 is a self-powered system for discharging high energy light beams, as shown in FIG. 1. The laser system 10 includes a laser unit 12, a power unit 14, and an exhaust system 16. The laser unit 12 is reconfigurable to discharge high energy light beams in multiple directions so that targets in different locations can be targeted as suggested in FIGS. 1 and 2. The power unit 14 burns fuel to provide electrical energy to the laser unit 12 so that the laser system 10 is self-powered. The exhaust system 16 controls exhaust gas from the power unit 14 to mitigate interference of the exhaust gas with the light beams from the laser unit 12.

The laser unit 12 is illustratively mechanically moved to discharge high energy light beams in multiple directions as suggested in FIGS. 1 and 2. The laser unit 12 includes a laser 18 and a laser actuation unit 19. The laser 18 produces high energy light beams via an internal light source and various other electrical and optical components. The laser actuation unit 19 mechanically moves the laser 18 to change the targeting of the laser 18. In some embodiments, the laser unit 12 may be configured to target different locations via electrical and/or optical controls. Such electrical and/or optical controls may be included with or in place of mechanical controls for directing the laser 18 in multiple directions.

The power unit 14 is configured to provide electrical power to the laser unit 12 in pulses that are converted to high energy light beams by the laser unit 12 as suggested in FIGS. 1 and 2. The power unit 14 includes a gas turbine engine 20 and an exhaust conduit 24. The gas turbine engine 20 burns fuel to produce mechanical energy that is converted to electrical energy. The exhaust conduit 24 is configured to conduct exhaust gasses produced during operation of the gas turbine engine 20. In some embodiments, an internal combustion engine may be used in place of the gas turbine engine 20.

The gas turbine engine 20 of the exemplary embodiment drives an electrical generator (not shown) that charges a capacitor unit (not shown). The gas turbine engine 20 includes a compressor 40, a combustor 42, and a turbine 44 as shown in FIGS. 1 and 2. The compressor 40 compresses atmospheric air and delivers the compressed air to the combustor 42. The combustor 42 mixes fuel with the compressed air and ignites the fuel. Combustion products from burning of fuel in the combustor interact with the turbine 44 and drive rotation of the turbine 44. The turbine 44 is coupled to the electrical generator to create electrical power from the mechanical rotation of the turbine 44. Exhaust gas is discharged from the turbine 44.

The exhaust system 16 controls the direction of exhaust gas exiting the turbine 44 of the gas turbine engine 20 as suggested in FIGS. 1 and 2. The exhaust system 16 includes an exhaust director 26 and a controller 28. The exhaust director 26 is reconfigurable to physically redirect the exhaust gas. The controller 28 is adapted to reconfigure the exhaust director 26 in response to information received from other components of the laser system 10.

The exhaust director 26 is reconfigurable between at least a first configuration and a second configuration as suggested in FIGS. 1 and 2. In the first configuration, shown in FIG. 1, the exhaust director 26 causes exhaust gas to move in a first direction as it exits the exhaust conduit 24. In the second configuration, shown in FIG. 2, the exhaust director 26 causes exhaust gas to move in second direction as it exits the exhaust conduit 24.

In the illustrative embodiment of FIGS. 1 and 2, the exhaust director 26 includes a snorkel 30 and a snorkel actuator 32. The snorkel 30 is fluidly coupled to the exhaust conduit 24. The snorkel actuator 32 is coupled to the snorkel 30 to rotate or reposition the snorkel 30 as illustratively shown by arrow 21. In the illustrative embodiment, the snorkel 30 is L-shaped with an inlet end 33 and an outlet end 35 opening in different directions. In other embodiments, it is conceived that the snorkel 30 may be provided by other conduits, ducts, valves, or the like that physically redirect exhaust gasses via walls as they exit the exhaust conduit 24.

The controller 28 is coupled to the snorkel actuator 32 to drive movement of the snorkel 30 as shown in FIGS. 1 and 2. The controller 28 is further coupled to the laser unit 12 to drive movement of the laser 18 and/or to receive information about the laser unit 12. The controller 28 illustratively includes a processor 50, a memory 52, and a sensor unit 54. The processor 50 executes instructions stored in the memory 52. The memory 52 stores control algorithms and other information for access by the processor 50. The sensor unit 54 illustratively includes various sensors for detecting atmospheric information and/or other information that is provided to the processor 50.

Figure 5:
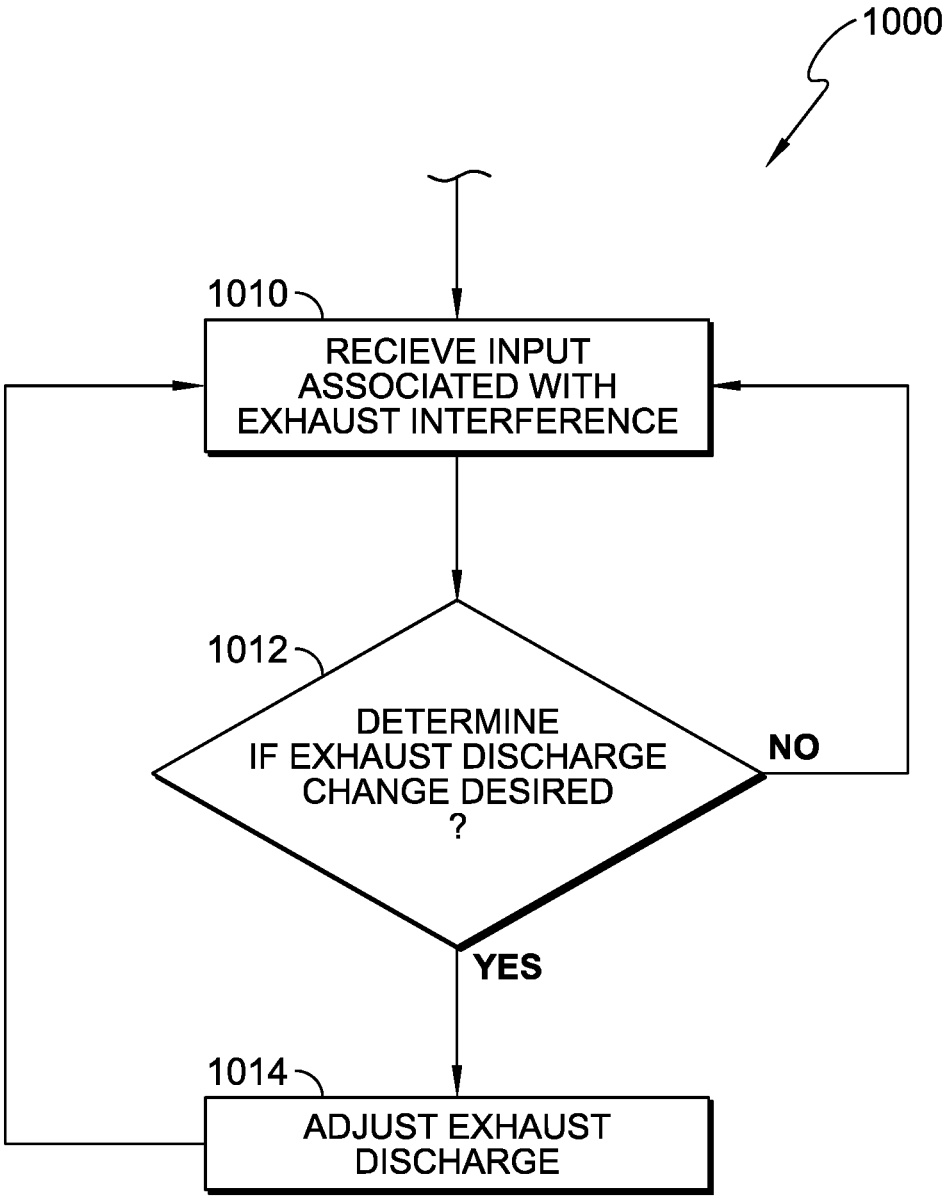
FIG. 5 is a block diagram of a control algorithm adapted for use by the laser systems of FIGS. 1-4 showing that exhaust gasses may be redirected in response to input information that may include atmospheric information and/or laser unit configuration information.

According to one illustrative algorithm 1000, the controller 28 may be configured to perform a number of method steps to control the exhaust system 16 as shown in FIG. 5. In step 1010, the controller 28 receives information associated with high energy beam guidance. The information received can include atmospheric information such as wind speed, wind direction, precipitation, humidity, fog, smog, and temperature. The information received can include laser unit configuration information such as position of the target, position of the power unit 14 in relation to the laser unit 18, orientation of the laser mount, length time that the laser 18 will discharge high energy beams, and strength of the high energy beam.

In step 1012 of the illustrative algorithm 1000, the controller 28 determines if a change in the discharge of exhaust gas is desired based on the input received, as shown in FIG. 5. If a change in the discharge of exhaust gas is desired, the algorithm 1000 advances to a step 1014 of the illustrative algorithm 1000.

In step 1014, the controller 28 adjusts the exhaust gas discharge via the exhaust system 16. Specifically, the controller 28 is coupled to the exhaust director 26 such that the controller 28 may reconfigure the exhaust director 26 from a first configuration to a second configuration via mechanical or electrical controls so that interference between laser beams and exhaust gas is mitigated.

If a change in the discharge of exhaust gas is not desired, the algorithm loops back to step 1010 as shown in FIG. 5. In this way, the system regularly or continuously updates based on changing information associated with beam guidance.

A second illustrative laser system 210 is shown in FIG. 3. The laser system 210 is substantially similar to laser system 10 as suggested by components having the same reference numbers. However, unlike the laser system 10, the laser system 210 includes an exhaust director 226 and a controller 228 that provide an exhaust system 216 as shown in FIG. 3. The exhaust director 226 includes a Coanda nozzle 230 and a control valve 232.

The Coanda nozzle 230 is fluidly coupled to the compressor 22 of the gas turbine engine 20 with the valve 232 coupled therebetween as shown in FIG. 3. The controller 228 is configured to open and close the valve 232 such that the exhaust director 226 may be reconfigured to manage exhaust gas interference with the high energy light beams discharged by the laser unit 12. Control algorithm 1000 may be executed by controller 228 so that interference between laser beams and exhaust gas is mitigated based on beam guidance information.

A third illustrative laser system 310 is shown in FIG. 4. The laser system 310 is substantially similar to laser systems 10 and 210 as suggested by components having the same reference numbers. However, unlike the laser systems 10 and 210, the laser system 310 includes an exhaust director 326 and a controller 328 that provide an exhaust system 316 as shown in FIG. 4. The exhaust director 326 includes a fan 330 and a fan actuator 332.

In the illustrative embodiment of FIG. 4, the fan 320 is coupled to a heat exchanger (not shown) of the laser unit 12. The fan actuator 332 is coupled to the fan 30 to rotate, reposition, redirect, and/or adjust the speed the fan 330. The controller 328 is coupled to the fan actuator 332 such that the exhaust director 326 may be reconfigured to selectively direct air flow along a path to interact with exhaust gas to manage exhaust gas interference with the high energy light beams discharged by the laser unit 12. Control algorithm 1000 may be executed by controller 328 so that interference between laser beams and exhaust gas is mitigated based on beam guidance information.

A fourth illustrative laser system 410 is shown in FIG. 6. The laser system 410 is substantially similar to laser systems 10, 210, and 310 as suggested by components having the same reference numbers. However, unlike the laser system 10, the laser system 410 includes an exhaust director 426 and a mechanical linkage 460 that provide an exhaust system 416 as shown in FIG. 6. The exhaust director 426 illustratively includes a snorkel 430. The snorkel 430 is fluidly coupled to the exhaust conduit 24. In the illustrative embodiment, the snorkel 430 is L-shaped with an inlet end 433 and an outlet end 435 opening in different directions. In other embodiments, it is conceived that the snorkel 430 may be provided by other conduits, ducts, valves, or the like that physically redirect exhaust gasses via walls as they exit the exhaust conduit 24.

The mechanical linkage 460 is coupled to the exhaust director 426 and the laser unit 12 to drive movement of the snorkel 430 in correlation with movement of the laser unit 12 as illustratively shown by arrow 21. In the illustrative embodiment of FIG. 6, the mechanical linkage 460 is a rod interconnecting the laser unit 12 and the snorkel actuator 432. In other embodiments, it is conceived that the mechanical linkage 460 may be a belt, chain drive, or the like that moves the snorkel 430 in response to movement of the laser 18 to redirect exhaust gasses as they exit the exhaust conduit 24.

Designs in accordance with the present disclosure relate to problems arising from an ambient medium distorting laser beams over a distance. The ambient medium may be exhaust gasses that misdirect the laser focus. In illustrative embodiments the air may be steered by pivoting the exhaust gasses with the snorkel 30, 430. The exhaust gasses may also be steered using the Coanda effect, which in illustrative embodiments, is achieved with the Coanda nozzle 230 being fluidly coupled to the compressor 22 of the gas turbine engine 20 such that the bled off air from the compressor 22 is conducted by the Coanda nozzle 230. The exhaust gasses may also be steered by gas cooler outputs deflecting the exhaust away such as from fan 330. The gas cooler outlets may be outlets of the heat exchanger that is used to manage the temperature of the laser unit 12.

In illustrative embodiments, input information may be used to direct the exhaust gas in such a way that it does not intersect with the laser beam. The input information may include the relative positions of the laser source and the exhaust source, the direction and speed of the wind, and the aiming altitude and azimuth of the laser target.

While the disclosure has been illustrated and described in detail in the foregoing drawings and description, the same is to be considered as exemplary and not restrictive in character, it being understood that only illustrative embodiments thereof have been shown and described and that all changes and modifications that come within the spirit of the disclosure are desired to be protected.

What is claimed is:

1. A laser system comprising a laser unit configured to discharge high energy light beams in multiple directions, a power unit coupled to the laser unit and configured to provide pulses of electrical power to the laser unit, the power unit including a gas turbine engine and an exhaust conduit configured to conduct exhaust gases produced during operation of the gas turbine engine, and an exhaust system configured to direct a discharge of the exhaust gases from the exhaust conduit, the exhaust system including an exhaust director and a controller, the exhaust director being reconfigurable from a first configuration in which the exhaust director causes the exhaust gases to move in a first direction as the exhaust gases exit the exhaust conduit to a second configuration in which the exhaust director causes the exhaust gases to move in a second direction as the exhaust gases exit the exhaust conduit, and the controller being coupled to the exhaust director to reconfigure the exhaust director from the first configuration to the second configuration in response to receipt of information associated with high energy light beam guidance so that interference of the exhaust gases with the high energy light beams from the laser unit is managed.

2. The laser system of claim 1, wherein the information associated with high energy light beam guidance includes atmospheric information.

3. The laser system of claim 1, wherein the information associated with high energy light beam guidance includes laser unit configuration information.

4. The laser system of claim 3, wherein the information associated with high energy light beam guidance includes atmospheric information.

5. The laser system of claim 1, wherein the exhaust director includes a snorkel fluidly coupled to the exhaust conduit and a snorkel actuator coupled to the snorkel, and the snorkel actuator is configured to reposition the snorkel.

6. The laser system of claim 5, wherein an outlet end of the snorkel and an outlet end of the exhaust conduit open to different directions.

7. The laser system of claim 1, wherein the exhaust director includes a Coanda nozzle.

8. The laser system of claim 7, wherein the Coanda nozzle is fluidly coupled to a compressor included in the gas turbine engine, the exhaust director includes a valve fluidly coupled between the Coanda nozzle and the compressor, and the controller is configured open and close the valve in order to reconfigure the exhaust director.

9. The laser system of claim 1, wherein the exhaust director includes a fan configured to selectively direct air flow along a path to interact with the exhaust gases as the exhaust gases exit the exhaust conduit.

10. The laser system of claim 9, wherein the fan is configured to direct air flow from a heat exchanger included in the laser unit.

11. A generator system adapted for use with an associated laser unit adapted to produce high energy light beams, the generator system comprising a power unit, the power unit including a gas turbine engine and an exhaust conduit configured to conduct exhaust gases produced during operation of the gas turbine engine, and an exhaust system configured to direct a discharge of the exhaust gases from the exhaust conduit, the exhaust system including an exhaust director that directs the exhaust gases as the exhaust gases exit the exhaust conduit and a controller coupled to the exhaust director, wherein the controller is configured to reconfigure the exhaust director to change a direction of the exhaust gases as the exhaust gases exit the exhaust conduit in response to receipt of information associated with high energy light beam guidance so that interference of the exhaust gases with the high energy light beams from the associated laser unit is managed.

12. The generator system of claim 11, wherein the information associated with high energy light beam guidance includes atmospheric information.

13. The generator system of claim 11, wherein the information associated with high energy light beam guidance includes laser unit configuration information.

14. The generator system of claim 13, wherein the information associated with high energy light beam guidance includes atmospheric information.

15. The generator system of claim 11, wherein the exhaust director includes a snorkel fluidly coupled to the exhaust conduit and a snorkel actuator coupled to the snorkel, wherein the snorkel is shaped to redirect the exhaust gases exiting the exhaust conduit, and the snorkel actuator is configured to reposition the snorkel.

16. The generator system of claim 11, wherein the exhaust director includes a Coanda nozzle configured to direct the exhaust gases exiting the exhaust conduit upon receipt of pressurized gas supplied to the Coanda nozzle.

17. The generator system of claim 11, wherein the exhaust director includes a fan configured to selectively direct air flow along a path to interact with the exhaust gases as the exhaust gases exit the exhaust conduit.

18. A laser system comprising a laser unit movable to discharge high energy light beams in multiple directions, a power unit coupled to the laser unit and configured to provide pulses of electrical power to the laser unit, the power unit including a gas turbine engine and an exhaust conduit coupled to the gas turbine engine to conduct exhaust gases produced during operation of the gas turbine engine, and an exhaust system configured to direct a discharge of the exhaust gases from the exhaust conduit, the exhaust system including an exhaust director that directs the exhaust gases as the exhaust gases exit the exhaust conduit and a mechanical linkage that extends from the laser unit to the exhaust director, wherein the mechanical linkage couples the exhaust director to the laser unit such that the exhaust director is moved to change a direction of the exhaust gases as the exhaust gases exit the exhaust conduit in response to movement of the laser unit so that interference of the exhaust gases with the high energy light beams from the laser unit is managed.

19. The laser system of claim 18, wherein the exhaust director includes a snorkel that is fluidly coupled to the exhaust conduit.

20. The laser system of claim 19, wherein the snorkel is mounted for repositioning relative to the exhaust conduit.

* * * * *